US005213319A

United States Patent [19]

Crowe et al.

[11] Patent Number: 5,213,319

[45] Date of Patent: May 25, 1993

[54] ADJUSTABLE FEEDER FOR SHINGLING CARTON BLANKS FROM A STACK AND METHOD FOR FEEDING THEREFROM

[75] Inventors: Norman P. Crowe; Kevin S. Mastrorocco, both of Milford; Kenneth L. Waters, Bethel, all of Ohio

[73] Assignee: International Paper Box Machine Company, Inc., Milford, Ohio

[21] Appl. No.: 840,130

[22] Filed: Feb. 24, 1992

[51] Int. Cl.[5] ..... B65H 5/00; B65H 3/04

[52] U.S. Cl. ..... 271/10; 271/34; 271/155

[58] Field of Search ..... 271/6, 7, 12, 13, 34, 271/152-155, 275, 10, 4; 414/797.2

[56] References Cited

U.S. PATENT DOCUMENTS

| | | | |
|---|---|---|---|
| 3,025,052 | 3/1962 | Gutteling | 271/12 X |
| 3,108,801 | 10/1963 | Van Dalen | 271/34 X |
| 3,493,728 | 2/1970 | Braden, Jr. et al. | 271/6 X |
| 3,635,463 | 1/1972 | Stobb . | |
| 3,734,490 | 5/1973 | Parks . | |
| 4,074,902 | 2/1978 | Bradbury | 271/34 |
| 4,431,175 | 2/1984 | Smith | 271/34 X |
| 4,475,732 | 10/1984 | Clausing et al. . | |
| 4,666,141 | 5/1987 | Labombarde . | |
| 4,869,486 | 9/1989 | Scarpa et al. . | |

FOREIGN PATENT DOCUMENTS

| | | | |
|---|---|---|---|
| 18173 | 2/1978 | Japan | 271/34 |
| 74842 | 4/1984 | Japan | 271/275 |
| 114239 | 7/1984 | Japan | 271/10 |

*Primary Examiner*—Robert P. Olszewski
*Assistant Examiner*—Boris Milef
*Attorney, Agent, or Firm*—Killworth, Gottman, Hagan & Schaeff

[57] ABSTRACT

For use with container production equipment, an apparatus is provided for controllably feeding a consistent stream of carton blanks in shingled form from a stack by applying constant pressure downwardly on a rotating belt which frictionally engages the top carton blanks to remove them from the stack. The preferred arrangement for removing carton blanks includes a device for applying pressure comprising an air pressure cylinder, and includes an arrangement for controlling the pressure applied to automatically maintain a constant pressure. The level of pressure applied may be adjusted to accommodate changing coefficients of friction between the feed belt and carbon blanks, and between adjacent carbon blanks, as well as to control the pressure applied to shingle a series of single carton blanks or to shingle a series of groups of two or more carbon blanks. A positioning arrangement permits positioning the point of application of pressure, thereby allowing adjustment of the shingle length, as well as adjustment to shingle carton blanks of different sizes.

22 Claims, 3 Drawing Sheets

ADJUSTABLE FEEDER FOR SHINGLING CARTON BLANKS FROM A STACK AND METHOD FOR FEEDING THEREFROM

BACKGROUND OF THE INVENTION

The present invention relates to automatic feeding of carton blanks on container production equipment, and in particular, to an adjustable, versatile feeder for feeding or shingling carton blanks from the top of a stack.

In the manufacture of carton blanks, the need often arises to feed carton blanks from a stack in preparation for the next step. For example, it is sometimes necessary to invert carton blanks in preparation for another operation, or to produce an even stream of carton blanks for infeed to other equipment.

Carton blanks may be fed from the bottom or the top of a stack to form a stream or shingled stream, as the application requires. Separate problems are presented when feeding carton blanks from the bottom or the top, and the present invention concerns the latter. Moving continuous belts have long been used to feed or peel off carton blanks from the top of stacks by frictional contact with the belt. Both the pressure applied to the top blank, and the coefficient of friction between adjacent carton blanks, will effect the feeding of blanks from the stack. As carton blanks are removed, stack height is typically adjusted to return the top blank to a predetermined level.

Because carton blanks are fed by friction, the pressure between the top of the stack and the belt affects the consistency of feeding. Variation in pressure, and thus inconsistent feeding, often results from imprecise control over the belt or pressure-applying means associated with the belt, or by variations in stack height adjustment. As well, inconsistent feeding may result from changeover to different carton blanks, which changes the coefficient of friction between carton blanks and the belt and between adjacent container blanks in the stack. Inconsistent feeding also may be induced by the speed at which the feeder is operated. As a result, carton blanks are fed irregularly, misfed in multiples, and otherwise shingled in an undesirable stream of carton blanks which causes surges and gaps at the infeed of downstream equipment. The resulting variation in stack height at the feeder may also result in a cycle of overcorrection, pressure variation, and continued misfeeding.

In an attempt to provide even feeding, Stobb, U.S. Pat. No. 3,635,463, discloses a sheet feeder for feeding sheets in shingled form from the top of a first stack to the bottom of a second stack. A sensor in contact with the top sheet of the first stack is used to control the position of the first stack at a desired level. A continuous belt in contact with the top sheet of the first stack is mounted on a frame including a rocker arm which pivots about a pin to apply pressure to the back of the continuous belt. A tension spring connected between one end of the rocker arm and a fixed support, urges the rocker arm to pivot downward to apply pressure with the other end to the back of the continuous belt, and thereby feed sheets. The device of Stobb does not work, however, to provide consistent pressure to shingle carton blanks. As the top of the stack varies in height, the rocker arm pivots downward to bring the continuous belt into contact with the top of the stack. The opposite end of the pivot arm moves upward, shortening the tension spring. Because the pressure applied by a spring varies with displacement, the pressure exerted by the spring changes and decreases, varying the pressure applied to the top of the stack and permitting inconsistent feeding to result.

Accordingly, the need exists for more precise, controllable means for feeding which produce a controlled, consistent stream of carton blanks for use in container production equipment. The need further exists for adjustable means for feeding carton blanks to accommodate the use of carton blanks having different coefficients of friction in the same production equipment.

SUMMARY OF THE INVENTION

The present invention satisfies that need by providing an apparatus for controllably feeding a consistent stream of carton blanks in shingled form from a stack for use with container production equipment. The apparatus includes means for delivering which delivers a stack of carton blanks to a feed point. From the feed point, means for removing the carton blanks removes a consistent stream of carton blanks from the stack and feeds them in shingled form to a means for receiving the stream of carton blanks. The means for removing feeds a consistent stream or series of carton blanks by applying constant pressure downwardly on a rotating feed belt to frictionally engage the carton blanks and remove them from the stack. The preferred means for applying pressure includes an air pressure cylinder which may extend along its longitudinal axis to compensate for variations in stack height. Means for controlling the pressure applying means are provided to maintain a constant downward pressure.

The means for controlling includes means for automatically maintaining constant pressure, such as a source of compressed air and a pressure regulating valve. Application of a constant downward pressure will compensate for variation in stack height, apply generally constant pressure to the top of the stack, and produce a consistent stream of carton blanks. The means for controlling also includes means for discretely adjusting the pressure applied to accommodate changes in the coefficients of friction between the feed belt and carton blanks, and between adjacent carton blanks. The means for discretely adjusting may also be used to adjust the applied pressure to shingle a series of single carton blanks or to shingle a series of groups of two or more carton blanks.

Further, the means for removing includes means for positioning the pressure applying means over the stack to vary the position of frictional engagement with the carton blanks. This allows for adjustment in the amount of shingle overlap, and permits adjustment of the position of the pressure applying means to accommodate the feeding of carton blanks of different shapes and sizes.

In addition, the present invention provides a method for feeding a series of carton blanks from a stack to controllably produce a consistent stream of shingled container blanks for use in container production. The method includes the steps of delivering a series of carton blanks in stacked relationship in a stack to a feed point; removing carton blanks in shingled form from the top of the stack by frictionally engaging the carton blanks at the feed point with a rotating, feed belt overlying the stack, including the steps of applying pressure downwardly on the inner surface of the feed belt to enhance frictional engagement with the carton blanks, and controlling the pressure applying means to apply a generally constant downward pressure; and, receiving the carton blanks in shingled form.

It is therefore a feature of the present invention to provide a more precise, controllable means for feeding which produce a controlled, consistent stream of carton blanks for use in container production equipment. A further feature of the present invention is to provide means for removing carton blanks from a stack which is adjustable to accommodate the use of carton blanks having different coefficients of friction in the same production equipment. Yet another feature of the present invention is to provide means for positioning the pressure applying means at different positions along the inner surface of the feed belt to accommodate changes in shingle overlap, and to facilitate feeding of carton blanks of different sizes and shapes. It is yet another feature of the present invention to provide a method for feeding a series of carton blanks from a stack to produce a controlled, consistent stream of shingled container blanks for use in container production. These and other objects and features of the present invention will be apparent from a review of the detailed description taken with the drawing figures included herein.

DETAILED DESCRIPTION OF THE PREFERRED EMBODIMENTS

Figure 1:
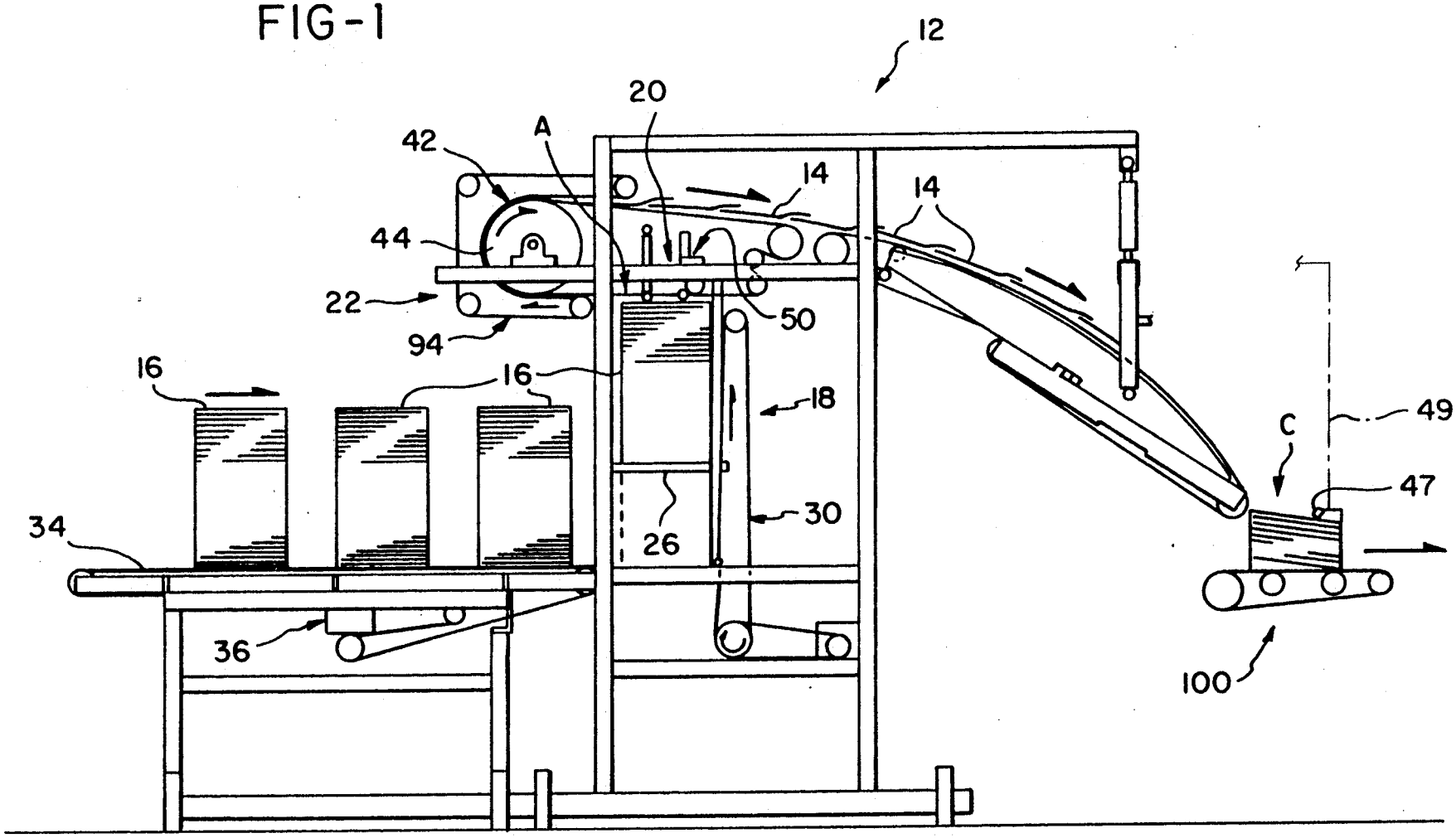
FIG. 1 is a schematic side elevational view of a container manufacturing device incorporating the feeding apparatus of the present invention.

Referring to FIG. 1, container production equipment is shown including an apparatus 12 for feeding a controllable, consistent stream of shingled carton blanks 14 in accordance with the present invention. Apparatus 12 includes means 18 for delivering a series of carton blanks 14 in a stack 16 to a feed point A, means 20 at the feed point A for removing the carton blanks 14 in shingled form from the top of the stack 16, and means 22 for receiving the carton blanks 14 in shingled form.

Figure 2:
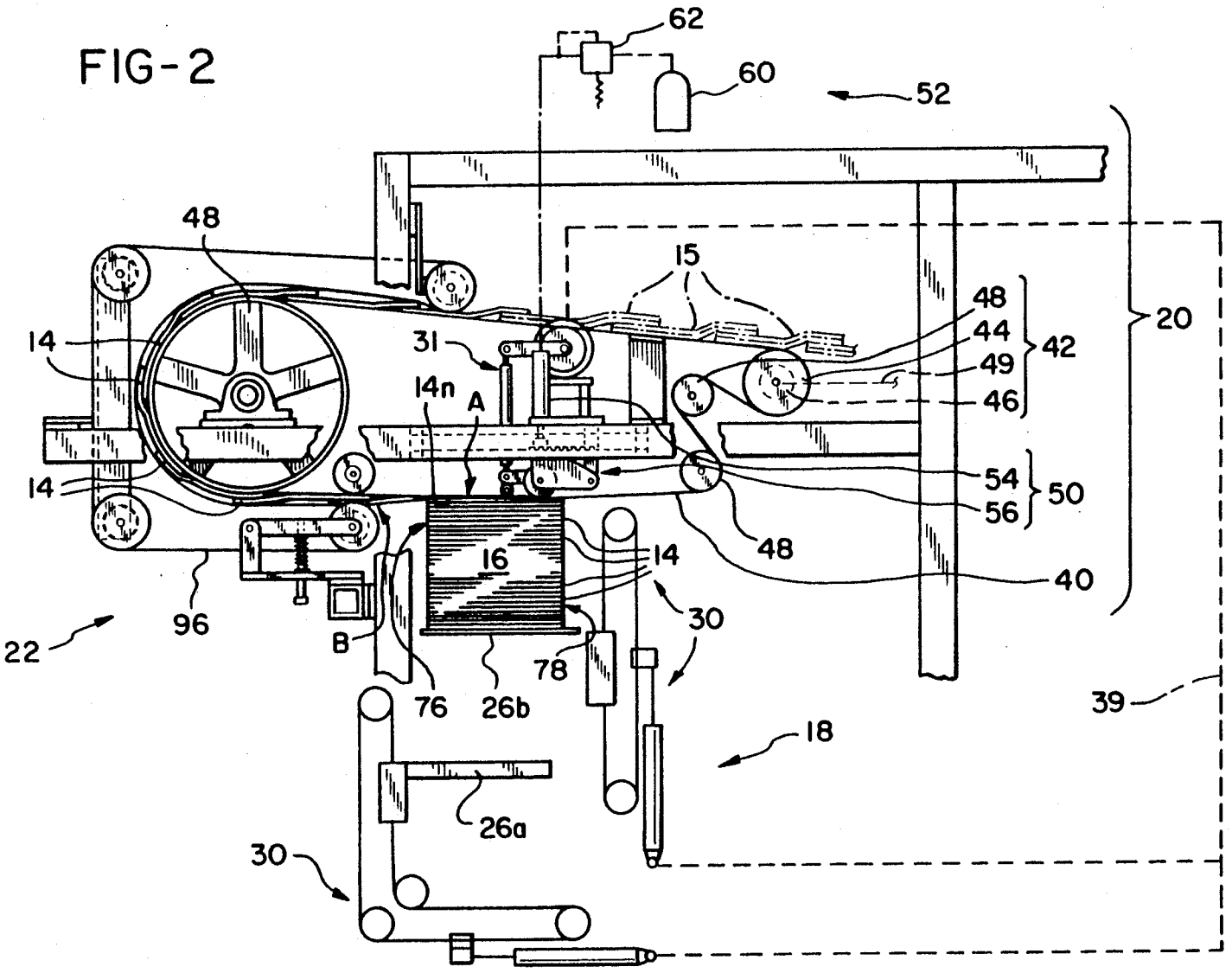
FIG. 2 is an enlarged side elevational view of the feeding apparatus of FIG. 1.

Referring to FIGS. 1 and 2, means 18 for delivering includes means for supporting the carton blanks 14 in stacked relationship in a stack 16, such as a tray 26, and means for positioning vertically the supporting means.

Means for positioning vertically the supporting means preferably includes means 30 for elevating the supporting means, and a stack height sensor 31 positioned to contact the top of the stack 16 at the feed point A. The means 30 for elevating the supporting means may be, for example a hydraulic cylinder-operated chain or belt elevator, as known in the art, and may be a single or double elevator. One elevator is shown in FIG. 1. Preferably, as shown in FIG. 2, two elevators, one above the other, are provided. The two elevators work together, transferring new stacks from the lower tray 26*a* to the upper tray 26*b*, and combining new stacks with the upper stack, as known in the art. Meanwhile, the top of the upper stack is maintained at a controlled height by the stack height sensor 31. The stack height sensor 31 is operatively connected, as representatively indicated by line 39 in FIG. 2, to the means 30 for elevating to limit the operation thereof and generally seeks to maintain the top of the stack 16 to a pre-set level at feed point A by raising the stack 16 as cartons blanks 14 are removed from the top.

Figure 3:
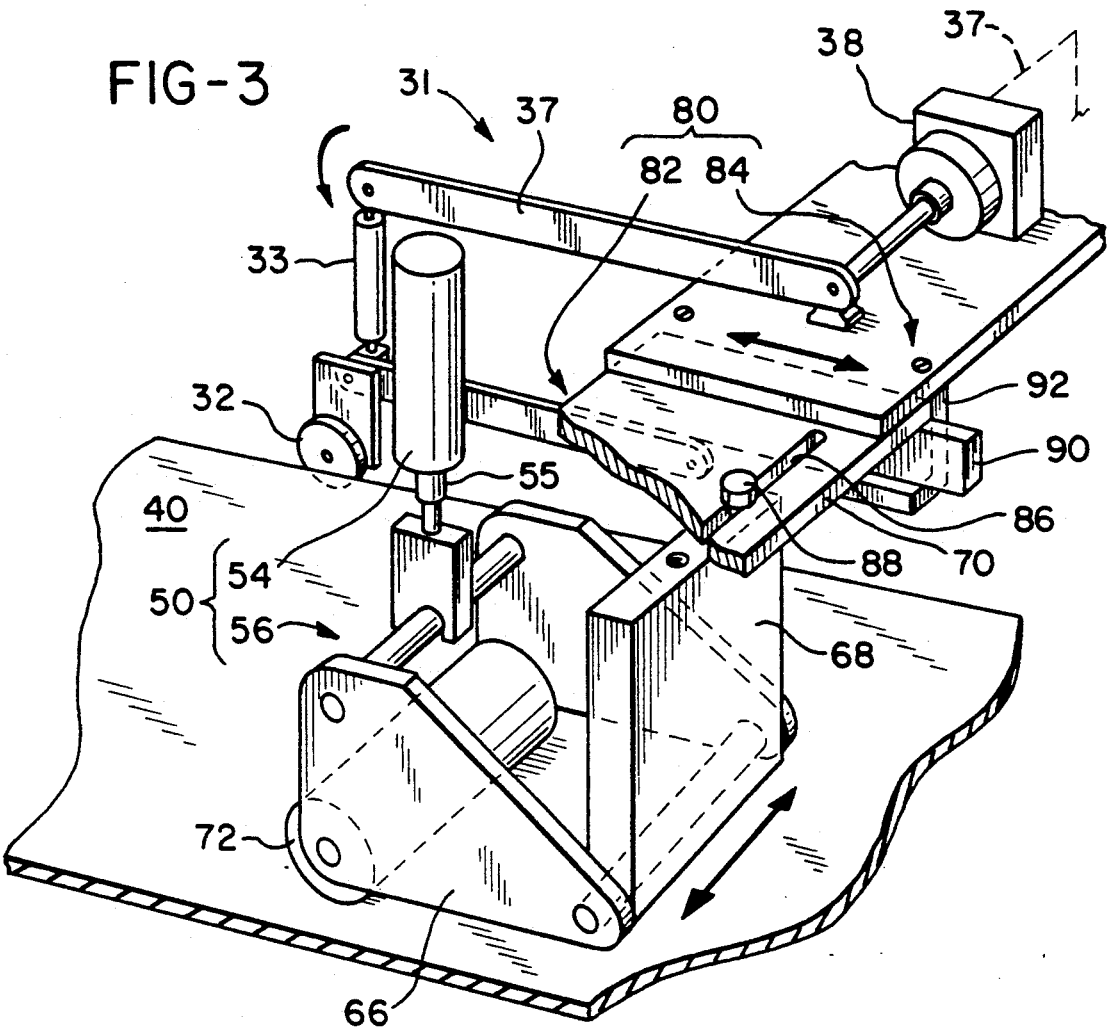
FIG. 3 is a detail perspective view of the preferred pressure applying means, means for controlling and means for positioning of the feeding apparatus of FIG. 2.

Stack height sensor 31 is shown in greater detail in FIG. 3. As shown, stack height sensor 31 includes a sensor roller 32, a tie rod 33, a pivotable sensing arm 37, and a rotary hydraulic valve 38 connected to arm 37. Sensor roller 32 is held in contact with the top of the stack 16 by tie rod 33, which moves arm 37 to rotate the hydraulic valve 38 as the stack height changes. Rotary hydraulic valve 38 is operatively connected to the means 30 for elevating by hydraulic line 39, and hydraulically controls the cylinders of the means 30 for elevating to raise or lower the stack. Rotary hydraulic valves of the type suitable for use in the present invention are commercially available as Rotovalve model 5, made by Rotovalve Corp., Rahway, N.J., or as Microtork, part no. 187 HSL from Picut Mfg. Col, Warren, N.J. The tray 26 to be controlled, when more than one is provided, is determined through valving arrangements known in the art. The position of the top of stack 16 at feed point A, is thereby established and maintained by the means for positioning vertically. The level of feed point A may be adjusted by adjusting the tie rod 33.

The means 18 for delivering may further include an infeed conveyor 34, and a means 36 for controlling the infeed conveyor, such as a motor and control system, as representatively shown in FIG. 1.

Shown in greater detail in FIG. 2, in accordance with the present invention, the means 20 for removing the carton blanks 14 in shingled form includes a rotatable feed belt 40, means 42 for rotatably driving the feed belt, means 50 for applying pressure downwardly on the feed belt, and means 52 for controlling the pressure applying means 50.

The feed belt 40 overlies stack 16 such that the outer surface of feed belt 40 is in frictional engagement with the carton blanks 14 at the feed point A. Feed belt 40 may be an endless belt, or other belt whose ends are connected by known means to form a loop. As further shown in FIG. 3, the feed belt is narrower than the carton blanks 14 to allow the stack height sensor 31 to contact the top of the stack. Preferably, feed belt 40 is a resilient belt made of V-Groove Urethane, such as are available from Habasit Corp., Atlanta, Ga., and has a very high coefficient of friction.

As shown in FIG. 2, the means 42 for rotatably driving the feed belt 40 preferably comprises a plurality of conventional rollers, including at least one drive roller 44 driven by a motor 46, and a plurality of idler rollers 48, shown in FIG. 2. Motor 46 is preferably a conventional hydraulic motor, but may also be electric, and its operation is controlled and modulated by a height sensor 47 located near point C in the infeed hopper of the next unit of container equipment 100, shown in FIG. 1. Height sensor 47 preferably controls motor 46 with an electrical signal, representatively shown as line 49 in FIGS. 1 and 2.

The means 50 for applying pressure downwardly on the feed belt 40 and the means 52 for controlling the pressure applying means 50, are shown best in FIG. 2. The means 52 for controlling ensures that pressure applying means 50 applies and maintains a constant downward pressure on feed belt 40 to provide consistent shingling.

Preferably, pressure applying means 50 comprises a pressure element, such as an air pressure cylinder 54, and means 56 for transmitting pressure applied therewith to spread the applied force out over a portion of the inner surface of the feed belt 40. Air pressure cylinder 54, for example, is a model SDR-17 available from Clippard Corp., Cincinnati, Ohio, and has a stroke length which defines an operating range through which the cylinder rod 5 extends and retracts along a longitudinal axis to accommodate changes in the stack height while maintaining constant downward pressure on the feed belt 40. By way of example, the model SDR-17 air pressure cylinder has a bore of 1 1/16 inches and a stroke of 1 inch.

The pressure controlling means 52 automatically maintains constant pressure in the air pressure cylinder 54, and is adjustable to different pressure levels. Preferably, pressure controlling means 52 includes a source 60 of compressed air and a pressure regulating valve 62 with automatic overpressure relief. By supplying air under constant pressure to the air pressure cylinder 54, a constant downward force is applied over the operating range of the air pressure cylinder 54 with the rod 55 extended to any length. Feed belt 40 is supported at rollers 48 upstream and downstream of the stack 16. It has been found that the air pressure cylinder 54 may be operated at low pressure, if desired, without performance being adversely affected by deflection up or down of the feed belt 40 as it tracks the variation in stack height. Pressure controlling means 52 is adjustable to permit changes in the level of pressure applied to any of a continuum of possible pressure levels. Regulation within the pressure range of 10 to 30 pounds per square inch gauge (psig) has been found sufficient to overcome the carton-to-carton friction and produce consistent shingling in applications involving carton blanks 14 having widths up to approximately 12 inches and lengths up to approximately 5 7/16 to 11 3/8 inches.

The ability to control the pressure level applied to the feed belt 40 is desirable to compensate for changes in the coefficient of friction between the feed belt 40 and carton blanks 14, and to compensate for changes in the coefficient of friction between adjacent carton blanks 14 due to use of different carton blanks, belt wear or belt replacement. In addition, adjustment in pressure level is desirable to vary the pressure to cause different quantities of carton blanks to form each shingle. For example, the means 52 for controlling may be adjusted to a first position to apply sufficient pressure on the feed belt 40 to shingle a series of single carton blanks 14, or used in a second position to shingle a series of groups 15 of two or more carton blanks 14, as shown in phantom in FIG. 2. Other positions and more numerous groups of carton blanks 14 are possible, however, the ability to control group size diminishes as the number of carton blanks 14 increases.

As shown in FIG. 3, the preferred means 56 for transmitting pressure to the feed belt 40 includes a roller 72 in a bracket 66 pivotally supported on a supporting frame 68, which is attached to a plate 70. Roller 72 is rotatably disposed in bracket 66, and bracket 66 is pivotally supported in frame 68 so that roller 72 may remain in contact with the inner surface of feed belt 40 despite stack height variation. The means 56 for transmitting pressure cooperates with air pressure cylinder 54 to transmit pressure to the feed belt 40. Air pressure cylinder 54 is attached to bracket 66 and, because the roller 72 therein contacts a constant area on the inner surface of the feed belt 40, constant pressure applied by the air pressure cylinder 54 is transmitted and applied as a constant pressure to the top of the stack 16.

Figure 4:
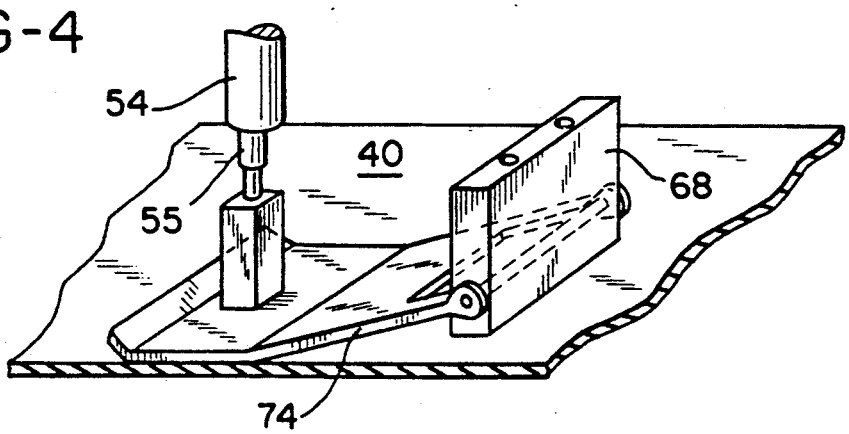
FIG. 4 is a detail perspective view of an alternative pressure applying means for the feeding apparatus of FIG. 2.

Referring now to FIG. 4, where like numbers represent like parts, an alternative means 56 for transmitting pressure is shown. A pressure plate 74 is provided, shaped to enhance smooth passage of feed belt 40 thereunder. Pressure plate 74 is also pivotally supported by supporting frame 68, which is attached to plate 70 as before. Pressure plate 74 may be shaped to provide flat surface contact, as shown, or may be rounded somewhat to provide edge contact much like roller 72 in FIG. 3. Alternatively, a pressure plate 74 may be mounted to the end of the air pressure cylinder 54, and may be slidably connected to supporting frame 68 in a vertical slot (not shown), rather than rotatably connected, to maintain constant pressure on feed belt 40 despite stack height variation.

Shown further in FIG. 3, the means 20 for removing also, preferably, includes means 80 for positioning the pressure applying means 50 over the stack 16 to vary the position of applied force and frictional engagement with the carton blanks 14. Means 80 for positioning shown include means 82 for laterally positioning, and means 84 for longitudinally positioning.

Lateral positioning means 82 may include, for example, a slotted aperture 86 in plate 70 for adjusting the lateral position of pressure applying means 50 with adjustable fasteners 88. The lateral positioning means 82 may be used to adjust the pressure applying means 50 to facilitate contact with carton blanks 14 having different widths, shapes, or features.

Longitudinal positioning means 84 may be, for example, rails 90, channels 92, and means for attaching plate 70 thereto, such as set screws which secure the channels 92 and plate 70 in position along rails 90. The longitudinal positioning means 84 may be used to adjust the position of the pressure applying means 50, in cooperation with the stack height sensor 31, to change the overlap between shingled carton blanks 14. That is, referring to FIG. 2, when the pressure applying means 50 are positioned closer to the leading edge 76 of the carton blanks 14 in stack 16, a short shingle overlap will result. This is because stack height sensor 31 will see the stack 16 as positioned at feed point A until the top carton blank **14*n* is almost completely removed. Conversely, when the pressure applying means 50 is positioned near the trailing edge 78 of the carton blanks 14, a long overlap results as the stack height sensor 31 senses the removal of the top carton blank 14*n* earlier, and causes means 30 for elevating to deliver the next carton blank 14 upward for contact with rotating feed belt 40**.

Shown in FIGS. 1 and 2, the receiving means 22 may comprise various receiving conveyors 94, such as belts, rollers or other surfaces which are moving, to receive the stream of shingled carton blanks 14. Preferred is a receiving conveyor 94 including a second feed belt 96, shown in FIG. 2, similar in construction to feed belt 40, and rotatably disposed in opposing relationship to a portion of feed belt 40. Second feed belt 96 may thereby form a nip B with feed belt 40 adjacent to the feed point A to receive the stream of shingled carton blanks 14 therefrom. Receiving means 22 convey the stream of shingled carton blanks to point C (see FIG. 1) where the apparatus 12 of the present invention interfaces with the next unit of container production equipment 100.

In sum, by supplying air under constant pressure to the air pressure cylinder 54, a constant downward force is applied over its operating range, and because the means 56 for transmitting pressure contacts a constant area on the inner surface of the feed belt 40, a constant pressure is applied to the top of the stack 16. Thus, the application of controllable, constant pressure to the feed belt 40 causes a generally constant pressure to be applied to the top of the stack 16, regardless of minor fluctuations in the height of the stack 16 caused by shingling or overcorrection by the means 30 for elevating. The frictional engagement of the feed belt 40 with the uppermost carton blank 14*n* on the stack 16 thereby remains consistent, and causes a controllable number of carton blanks 14 to be fed for each shingle in a stream of carton blanks 14.

In addition, the present invention provides a method for feeding a series of carton blanks 14 from a stack 16 to produce a stream of shingled container blanks for use in container production. The method includes the steps of delivering a series of carton blanks 14 in stacked relationship in a stack 16 to a feed point A; removing carton blanks 14 in shingled form from the top of the stack 16 by frictionally engaging the carton blanks 14 at the feed point A with an feed belt 40 overlying the stack 16, which includes the steps of rotatably driving the feed belt 40, applying pressure downwardly on the inner surface of the feed belt 40 to enhance frictional engagement with the carton blanks 14, and controlling the pressure applying means 50 to automatically apply a generally constant downward pressure; and receiving the carton blanks 14 in shingled form.

Additionally, the step of removing may include the step of adjusting the means 52 for controlling the pressure to one of a plurality of positions to apply a different pressure to the feed belt 40. More particularly, the step of removing may include the step of adjusting the means 52 for controlling to a first position, and removing a series of single carton blanks 14 in shingled form. Alternatively, the step of removing may include the step of adjusting the means 52 for controlling to a second position, and removing a series of groups of two carton blanks 14 in shingled form. The step of removing may also further include the step of positioning the means 56 for applying pressure over the stack 16 at a desired location. It is understood that the steps of the method of the present invention may be defined further in accordance with the operation of the apparatus 12 which is described in detail above.

While certain representative embodiments and details are shown for purposes of illustrating the invention, it will be apparent to those skilled in the art that various changes in the apparatus and method disclosed herein may be made without departing from the scope of the invention, which is defined in the appended claims.

What is claimed is:

1. An apparatus for feeding a series of carton blanks for container production from the top of a stack of carton blanks delivered to a feed point, said apparatus comprising:

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

pneumatic means for applying pressure downwardly on the inner surface of said feed belt to enhance frictional engagement with said carton blanks; and means for controlling said pneumatic means for applying pressure to apply a substantially constant downward pressure to provide consistent shingling.

2. The apparatus of claim 1 further comprising:

means for delivering a series of carton blanks in stacked relationship to said feed point, said means for delivering including:

means for supporting said carton blanks in stacked relationship in a stack; and means for positioning vertically said means for supporting to deliver said carton blanks at said feed point from the top of said stack.

3. The apparatus of claim 2 wherein said means for positioning vertically said means for supporting comprises:

means for elevating said means for supporting; and a stack height sensor positioned to contact the top of said stack at said feed point and operatively connected to said means for elevating to limit the operation thereof.

4. An apparatus for feeding a series of carton blanks for container production from the top of a stack of carton blanks delivered to a feed point, said apparatus comprising:

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

means for applying pressure downwardly on the inner surface of said feed belt to enhance frictional engagement with said carton blanks, wherein said means for applying pressure comprises:

an air pressure cylinder; and means for transmitting pressure from said air pressure cylinder, said means for transmitting pressure cooperating with said air pressure cylinder and in contact with said inner surface of said feed belt; and means for controlling said means for applying pressure to apply a substantially constant downward pressure to provide consistent shingling.

5. The apparatus of claim 4 wherein said means for controlling said means for applying pressure comprises:

a source of compressed air; and a pressure regulating valve attached thereto to maintain the air pressure from said source at a constant pressure.

6. The apparatus of claim 4 wherein said means for transmitting pressure comprises:

a bracket pivotally disposed for rotation through an arc in cooperation with said air pressure cylinder; and a roller rotatably disposed in said bracket and in contact with said inner surface of said feed belt.

7. The apparatus of claim 4 wherein said means for transmitting pressure comprises a plate pivotally disposed for rotation through an arc in cooperation with said air pressure cylinder, and said plate in contact with said inner surface of said feed belt.

8. An apparatus for feeding a series of carton blanks for container production from the top of a stack of carton blanks delivered to a feed point, said apparatus comprising:

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

means for applying pressure downwardly on the inner surface of said feed belt to enhance frictional engagement with said carton blanks; and means for controlling said means for applying pressure to apply a substantially constant downward pressure to provide consistent shingling, wherein said means for controlling said means for applying pressure is adjustable to one of a plurality of pressure levels.

9. The apparatus of claim 8 wherein said means for controlling is adjustable to a first position at which said means for removing consistently removes a series of single carton blanks in shingled form.

10. The apparatus of claim 9 wherein said means for controlling is adjustable to a second position at which said means for removing consistently removes a series of groups of two carton blanks in shingled form.

11. An apparatus for feeding a series of carton blanks for container production from the top of a stack of carton blanks delivered to a feed point, said apparatus comprising:

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

means for applying pressure downwardly on the inner surface of said feed belt to enhance frictional engagement with said carton blanks;

means for positioning said means for applying pressure at different positions along an inner surface of said feed belt vary the position of frictional engagement between said feed and said carton blanks along the top of said stack at said feed point; and means for controlling said means for applying pressure to apply a substantially constant downward pressure to provide consistent shingling.

12. The apparatus of claim 11 wherein said means for positioning includes means for positioning laterally and means for positioning longitudinally.

13. An apparatus for feeding a series of carton blanks from a stack of carton blanks for container production, said apparatus comprising:

means for delivering a series of carton blanks in stacked relationship to a feed point, said means for delivering including:

means for supporting said carton blanks in stacked relationship in a stack; and means for positioning vertically said means for supporting to deliver said carton blanks at said feed point from the top of said stack;

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

means for applying pressure downwardly on the inner surface of said feed belt to enhance frictional engagement with said carton blanks, said means for applying pressure comprising an air pressure cylinder, and means for transmitting pressure from said air pressure cylinder cooperating therewith and in contact with said inner surface of said feed belt;

means for controlling said means for applying pressure to automatically apply a generally constant downward pressure, said means for controlling comprising a source of regulated air pressure and means for adjusting said source of regulated air to a plurality of pressure levels for consistently shingling groups of one or more container blanks; and means for positioning said means for applying pressure at different positions along the inner surface of said feed belt to vary the position of frictional engagement with said carton blanks along the top of said stack at said feed point.

14. A method for feeding a series of carton blanks for container production from the top of a stack of carton blanks delivered to a feed point, said method comprising the steps of:

removing carton blanks in shingled form from the top of said stack, said step of removing including the steps of:

frictionally engaging said carton blanks at said feed point with the outer surface of an feed belt overlying said stack;

rotatably driving said feed belt;

applying pressure downwardly on the inner surface of said feed belt to enhance frictional engagement between said feed belt and said carton blanks with an air pressure cylinder and means for transmitting pressure from said air pressure cylinder to said inner surface of said feed belt;

controlling said means for applying pressure to apply a generally constant downward pressure, said step of controlling comprising regulating a source of air pressure to maintain a substantially constant pressure level.

15. The method of claim 14 further comprising, prior to the step of removing, the steps of:

delivering a series of carton blanks in stacked relationship to a feed point, said step of delivering including the steps of:

supporting said carton blanks in stacked relationship in a stack on means for supporting;

displacing said means for supporting upwardly with means for elevating to deliver said carton blanks at said feed point from the top of said stack; and limiting the upward displacement of said means for supporting with a stack height sensor positioned to contact the top of said stack at said feed point and operatively connected to said means for elevating to limit the operation thereof.

16. The method of claim 14 wherein said step of removing comprises the steps of:

adjusting said means for applying pressure to a first position to provide a first pressure; and removing a series of single carton blanks in shingled form.

17. The method of claim 14 wherein said step of removing comprises the steps of:

adjusting said means for applying pressure to a second position to provide a second pressure; and removing a series of groups comprising two carton blanks in shingled form.

18. The method of claim 14 further comprising the step of positioning said means for applying pressure along said inner surface of said feed belt to optimize the frictional contact with said carton blanks.

19. The method of claim 15 further comprising the step of positioning said means for applying pressure and said stack height sensor longitudinally along said inner surface of said feed belt to establish a desired shingle overlap.

20. An apparatus for feeding a series of carton blanks for container production from the top of a stack of carton blanks delivered to a substantially variable feed point, said apparatus comprising:

means at said feed point for removing carton blanks in shingled form from the top of said stack, said means for removing comprising:

a feed belt overlying said stack such that the outer surface of said feed belt is in frictional engagement with said carton blanks at said feed point;

means for rotatably driving said feed belt;

means for applying pressure downwardly on the inner surface of said feed belt to enhance frictional engagement with said carton blanks; and means for controlling said means for applying pressure to apply a substantially constant downward pressure at said substantially variable feed point to provide consistent shingling.

21. The apparatus of claim 20 wherein said substantially variable feed point varies in position throughout a range exceeding the thickness of a single carton blank.

22. The apparatus of claim 20 wherein said means for applying pressure comprises a pneumatic means for applying pressure.

* * * * *

UNITED STATES PATENT AND TRADEMARK OFFICE

CERTIFICATE OF CORRECTION

PATENT NO. : 5,213,319
DATED : May 25, 1993
INVENTOR(S) : Crowe et al

It is certified that error appears in the above-indentified patent and that said Letters Patent is hereby corrected as shown below:

Col. 9, line 45, "feed belt vary" should read --feed belt to vary--.

Signed and Sealed this

First Day of February, 1994

Bruce Lehman

*Attest:*

BRUCE LEHMAN

*Attesting Officer*

*Commissioner of Patents and Trademarks*